US005379281A

United States Patent [19]

Koch

[11] Patent Number: 5,379,281

[45] Date of Patent: Jan. 3, 1995

[54] ANALOG TIMEPIECE INCLUDING MEANS FOR SIGNALLING A CHANGE OF MODE

[75] Inventor: Daniel Koch, Crémines, Switzerland

[73] Assignee: Eta SA Fabriques d'Ebauches, Granges, Switzerland

[21] Appl. No.: 119,587

[22] Filed: Sep. 13, 1993

[30] Foreign Application Priority Data

Sep. 25, 1992 [CH] Switzerland ..... 03003/92-9

[51] Int. Cl.[6] ..... G04B 23/02

[52] U.S. Cl. ..... 368/72; 368/76; 368/243; 368/223

[58] Field of Search ..... 368/72–76, 368/243–250, 223

[56] References Cited

U.S. PATENT DOCUMENTS 4,223,522 9/1980 Nomura et al. .
4,253,172 2/1981 Nomura .
4,470,707 9/1984 Chambon et al. .

FOREIGN PATENT DOCUMENTS 476425 3/1992 European Pat. Off. .
642811 5/1984 Switzerland .
2087601 5/1982 United Kingdom .

*Primary Examiner*—Bernard Roskoski
*Attorney, Agent, or Firm*—Sughrue, Mion, Zinn, Macpeak & Seas

[57] ABSTRACT

The invention concerns a timepiece. Such timepiece exhibits at least two selectable modes of operation, a first referred to as time and a second referred to as nontime, and it comprises at least one hours hand (h) and one minutes hand (m) capable of being independently actuated by motor means (18, 20), electronic management means (22) for said modes of operation and an external control organ capable of operating on said management means, such timepiece being characterized in that it includes visual means for signalling entry into the non-time mode of operation, such signalling means being formed by said hours (h) and minutes (m) hands acting in an automatic and systematic fashion at least, upon entry into the nontime operating mode. The invention is applicable to an electronic timepiece having an analog display.

5 Claims, 4 Drawing Sheets

ANALOG TIMEPIECE INCLUDING MEANS FOR SIGNALLING A CHANGE OF MODE

The present invention concerns an analogue timepiece including means for signalling a change of mode.

More specifically, the present invention refers to a timepiece having several operating modes of the type described in the patent application CH 03031/900 (U.S. Ser. No. 07/761 232).

BACKGROUND OF THE INVENTION

The timepiece described in this document includes effectively, in addition to the normal operating mode, referred to as the time operating mode since furnishing the hour and the minute, an additional mode which can be actuated by the user by a manipulation on the stem. Such operating mode enables effecting an adjustment of the hands in a temporal reference position different from the standard reference in which both hours and minutes hands are superposed at noon.

Such operating mode referred to as the temporal reference adjustment mode enables fixing the temporal reference position marking the zero-hour, zero-minute opposite any mark whatsoever on the dial. Thus one can, for example, transform a standard timepiece such as a watch into a watch for left handed persons, that is to say, with the time setting crown at the left and no longer at the right.

This operating mode must however be practised with care since it is understood that the adjustment from a new temporal reference position completely modifies the time information provided by the hands.

For this reason, it appears necessary to provide signalling means capable of alerting the user at a chosen moment in a judicious manner in order that he may avoid effecting false manoeuvres, but without complicating the structure of the timepiece, nor increasing its price.

Thus, the present invention has as purpose to provide a timepiece presenting several operating modes such as an adjustment mode for a temporal reference and including efficient signalling means, but of the most simple conception and as little burdensome as possible.

SUMMARY OF THE INVENTION

The present invention thus has as objective a timepiece having an analog display exhibiting at least two selectable operating modes, a first referred to as time mode and a second referred to as non-time mode, and comprising at least one hours hand and one minutes hand capable of being independently actuated by motor means, electronic management means for said modes of operation and an external control organ capable of operating on said management means, characterized in that it includes visual means for signalling entry into the non-time mode of operation, such signalling means, which are formed by said hours and minutes hands, acting in an automatic and systematic fashion at least upon entry into the non-time operating mode.

According to another characteristic, the signalling means consist of a complete rotation of at least one hand.

More specifically, the signalling means consist of a complete rotation of at least one hand after the latter has been brought back into an initial temporal reference position.

It will be further specified that the signalling means consist of a simultaneous rotation of both hours and minutes hands at the same speed in a constant relative position.

In a preferred manner, the signalling means consist of a rotation of the hours and minutes hands in a superposed configuration of said hands after they have been brought back into such configuration in the initial temporal reference position.

To this effect, the invention includes at least one register called the signalling register coupled to management means, such register including a value representative of a number necessary for the complete rotation of at least one hand.

Other characteristics and advantages of the invention will appear upon reading the detailed description which follows, made having reference to the attached drawings which are given solely by way of example.

DESCRIPTION OF THE PREFERRED EMBODIMENT

Figure 1:
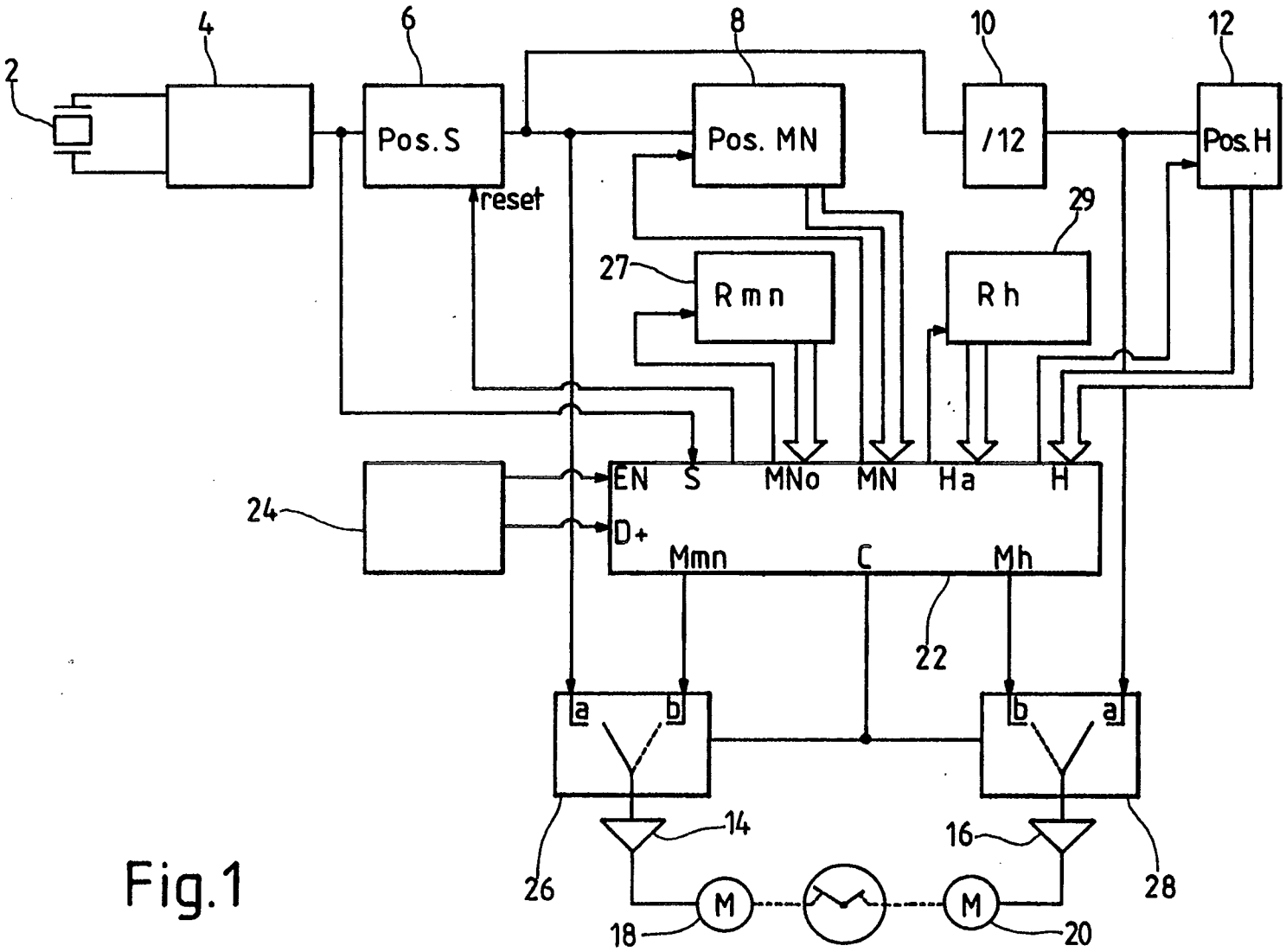
FIG. 1 shows in the form of a schematic block a timepiece which constitutes an embodiment of the present invention.

There has been shown on FIG. 1, in the form of a schematic block, a timepiece constituting one embodiment of the present invention. Such timepiece comprises in series a quartz oscillator 2, a divider chain 4 furnishing a signal at 1 Hz, a seconds counter 6 furnishing a minutes signal and forming in particular a digital indicator of the position of the seconds hand (not shown) and a counter 8 basically forming a digital indicator of the position of the minutes hand m.

The timepiece according to the invention further comprises a divider by twelve referenced 10, receiving the output signal of the seconds counter 6, and a counter 12 referred to as the hours counter, forming a digital indicator of the position of the hours hand h.

Figure 4:
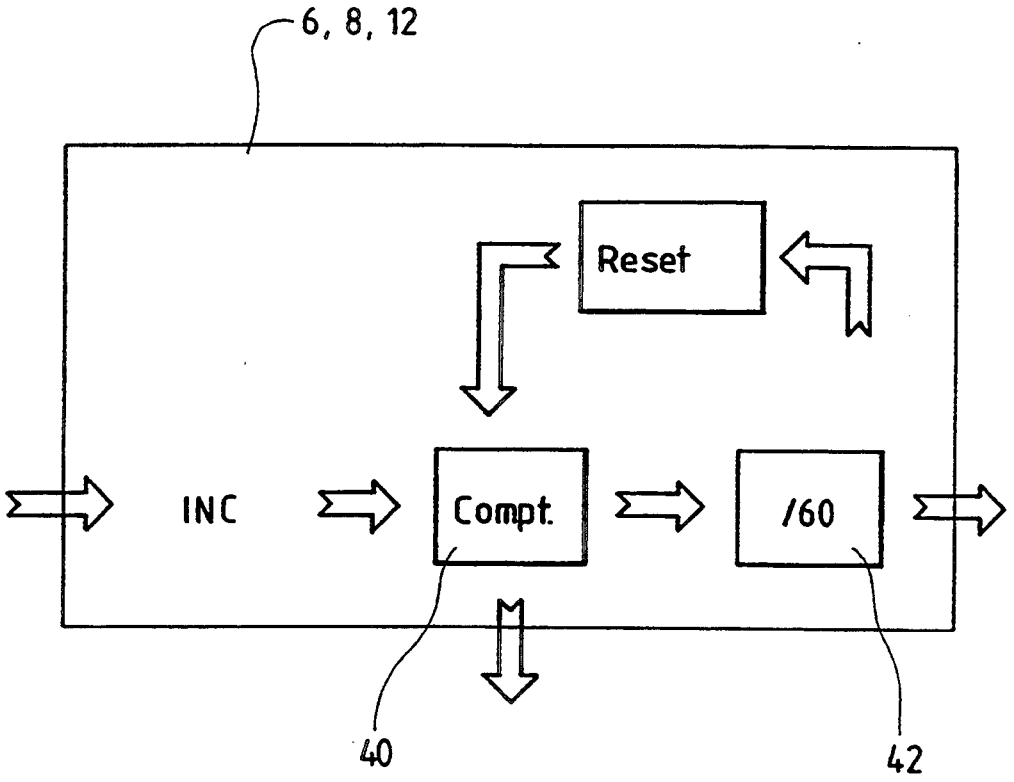
FIG. 4 is a schematic of the three position counters shown on FIG. 1.

The hours counter 72, the input of which is coupled to the output of divider 10, receives from this latter information every twelve minutes. Counters 6, 8 and 12 are counters by sixty the mode of operation of which is shown schematically on FIG. 4.

As is seen on this figure, the pulses serving for incrementation (INC) are received by the counters 6, 8, 12 from the up side (to the left on the figure). Such successive pulses are counted by a binary counter 40 with at least a six bit capacity which they increment. Such counter 40 is coupled to a divider by sixty referenced 42 which furnishes the output pulses and which initializes the counter 40 every sixty pulses (Reset).

As will be understood hereinafter, counters 8 and 12 define respectively, in the normal operating mode, the angular position of the minutes hand m and hours hand h on the dial of the timepiece relative to the temporal reference position. The timepiece described here not including a seconds hand, the seconds counter 6 serves solely to furnish a minutes signal and to increment the other counters 8, 12.

Figure 2:
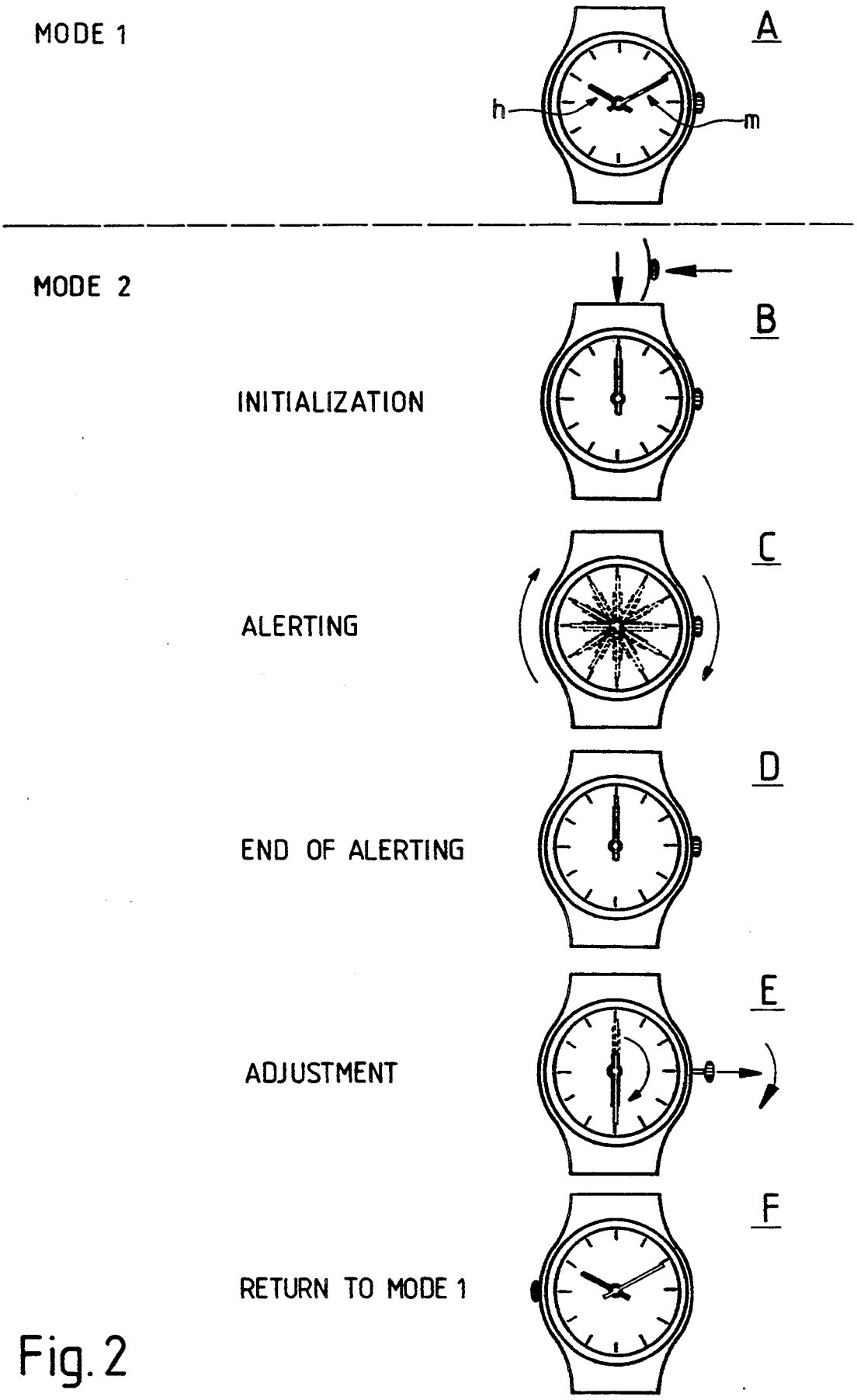
FIG. 2 shows the different stages of operation of the timepiece shown on FIG. 1.
Figure 3:
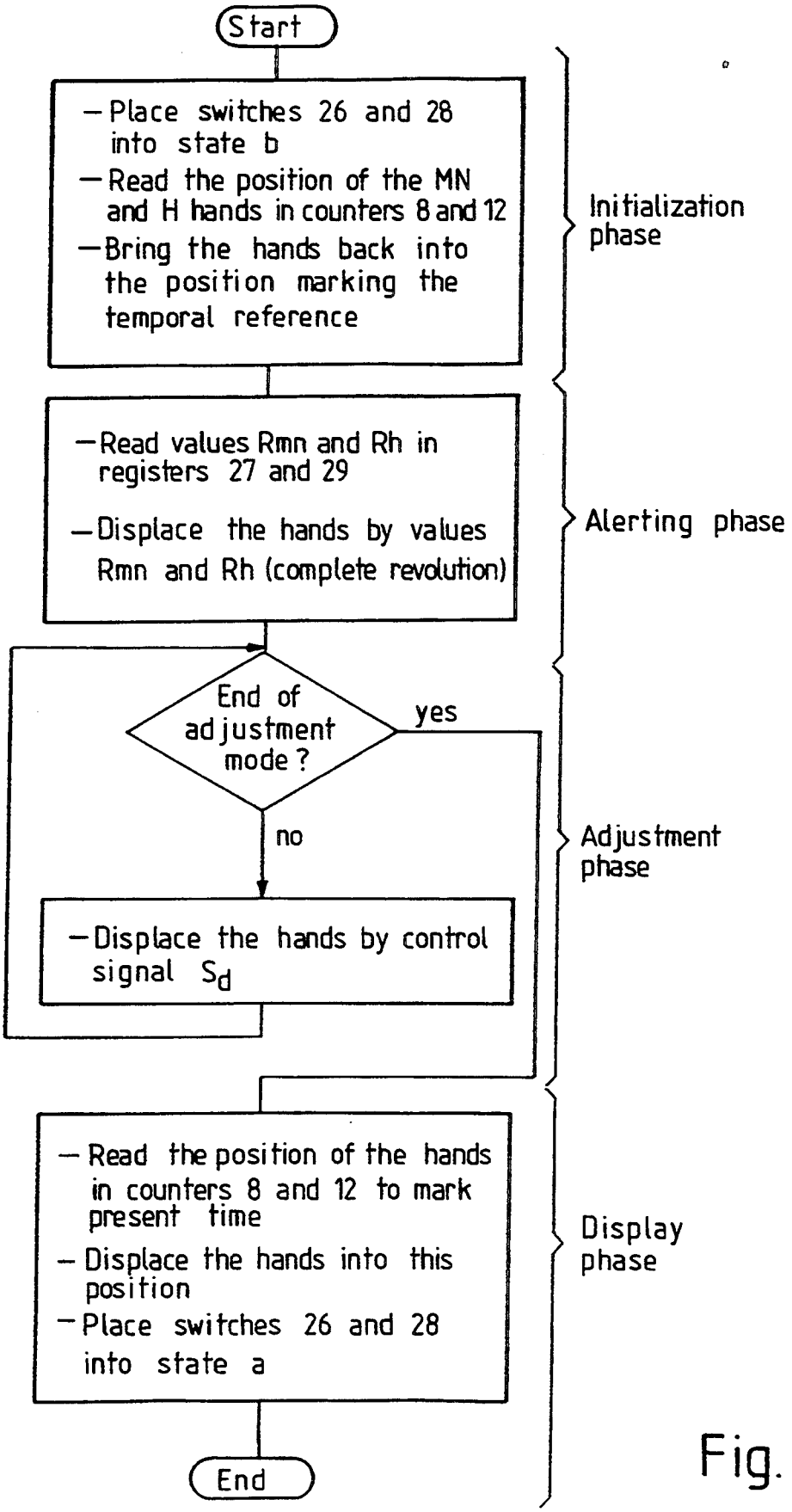
FIG. 3 is a flow chart of the operation of the invention.

The timepiece according to the invention is furthermore provided with two motors 18 and 20 respectively controlled by power circuits 14 and 16 in order to drive respectively the minutes hand m and the hours hand h (FIG. 2). Circuits 14 and 16 receive, in the normal operating mode, the pulses applied respectively to the inputs of the minutes counter 8 and hours counter 12.

The arrangement of the motors and gearing of the present invention will not be described here. Effectively, there is already known, in particular from the document EP-0 393 605, horological movements comprising several motors capable of independently driving the hands displaying minutes and hours.

To facilitate understanding of the invention, it will be here specified only that motors 18 and 20 and their associated gear trains are adapted to cause the minutes and hours hands to advance through a step of one sixtieth of a revolution upon reception of a control pulse from the power circuits 14 and 16.

This is why in the normal operating mode, counter 8 shows in a binary form a value comprised between 0 and 59 (with initialization at 60) directly representative of the angular position of the minutes hand m.

The hours hand h being also capable of displacement through a sixtieth of a revolution per step at each pulse, it passes from one hours mark to another in five steps at the rate of one step every twelve minutes, thanks to the divider by 12 referenced 10. Thus, counter 12 records, in the normal operating mode, each displacement of the hours hand h and includes in a binary form a value comprised between 0 and 59 (with initialization at 60) directly representative of the angular position of the hours hand h.

The elements of the timepiece shown on the schematic block of FIG. 1 which have just been described, explain the operation of such timepiece as far as concerns the normal time display.

As can be seen on FIG. 1, the timepiece according to the invention further comprises electronic management means 22, referred to as adjustment means, enabling in the application as described to modify the temporal reference position corresponding by definition to the zero of the position of the minutes hand and to the zero of the position of the hours hand in an additional operating mode referred to as the non-time operating mode or adjustment mode for the temporal reference.

Such electronic management means or adjustment means 22 include inputs MN and H in order to receive the contents of the minutes counter 8 and hours counter 12, an actuation input EN and an input D for data of displacement of the hands forward and backwards.

The signals applied onto the inputs EN and D are furnished by an interpretation circuit 24 capable of interpreting and furnishing information relative to the position and to the displacement (sense and speed) of the control stem (not shown). The operation of the control stem and of the interpretation circuit 24 are already known from document EP-0 175 961 and consequently will not be described here in detail.

The electronic management means 22 also include two outputs Mmn and Mh in order to deliver pulses to motors 18 and 20 and a control output C in order to manage the state of the two switches 26, 28 placed at the input of the power circuits 14, 16 and arranged to transmit thereto either pulses applied onto the inputs of the position counters of the minutes hand 8 and hours hand 12 when such switches are in a first position referenced a, or the pulses delivered by the electronic management means 22 when these same switches are in a second position referenced b.

The electronic management means can be advantageously provided in the form of an integrated circuit including a programmed micro-controller. The person skilled in the art will be able, from the indications provided herein, to bring about programming of the micro-controller in a manner to cause it to execute the described functions.

The electronic management means 22 are furthermore advantageously associated with two registers for hours 29 and minutes 27, including respectively two numbers Rh and Rmn, in binary form, which, in a preferred embodiment, are chosen to be equal.

In the normal time display mode, the electronic management means 22 are inactive and motors 18, 20 receive pulses applied to the inputs of the position counters for the minutes hand 8 and hours hand 12.

Actuation of the electronic management means 22 is obtained, for example, by a special manipulation of the control stem which brings about the emission by the interpretation circuit 24 of an actuation signal towards the input EN of the management means 22.

The management means 22 then execute successively in the new operating mode an initialization phase, an alerting phase, an adjustment phase, possibly an additional alert phase, then a display phase.

Initialization Phase

The watch being in its normal operational mode corresponding to the standard display of time (illustrated by step A), the initialization function is actuated, for example by pushing on the stem with pressure maintained during a predetermined time (step B).

The displacement of the stem brings about emission by the interpretation circuit 24 (FIG. 1) of a signal towards input EN of the electronic management means 22.

The electronic management means 22 then emit a signal at their output C in order to place switches 26 and 28 into state b.

Simultaneously, the electronic management means 22 read the contents of counters 8 and 12 in order to know the respective positions of the minutes m and hours h hands.

The electronic management means 22 then emit, in a preferred embodiment, the number of pulses required on outputs Mmn and Mh in order to bring back hands m and h, via power circuits 14, 16 and motors 18, 20, into the temporal reference position previously defined, that is to say, that they would have if the contents of counters 8 and 12 were equal to zero (this does not affect operation of counters 6, 8 and 12).

In another embodiment, solely one of the hands is displaced and this by emitting a signal at one only of the outputs Mmn or Mh, the other hand remaining fixed in position.

Alerting Phase

In order to draw the attention of the user to the entry into this operational mode and in order to signal the actuation of the initialization, the electronic management means 22 take the contents (values Rmn and Rh) from the register or registers 27 and 29 and emit, as always, at outputs Mmn and Mh, the number of pulses corresponding to number Rmn and/or Rh contained, in binary form in the register or registers 27, 29.

Such pulses are received by motors 18 and 20 via the power circuits 14 and 16. The numbers Rmn and Rh contained in registers 27 and 29 being advantageously both equal to 60, the hours and minutes hands, in a preferred embodiment, are both displaced through a number of steps corresponding thereto and they effect together, at the same speed, a rotation of 360°, that is to say, through one revolution of the dial in order to return to their predetermined temporal reference position.

In the case in which the predetermined temporal reference position corresponds to a configuration in which the hands are superposed, the concomitant rotation of the hands is brought about under such superposed form.

It is understandable thus that the user is warned in a very simple manner of the entry into the operational mode corresponding to the definition of a new temporal reference position, the operation of which will be explained hereinafter.

There has thus been furnished visual signalling means formed by the hours and minutes hands themselves, such means acting in an automatic and systematic fashion immediately at the time of entry into the present non-time operating mode.

It will also be understood that in another embodiment in which only one of registers 27 or 29 is taken into account and in which solely the corresponding hand is displaced, such signalling means consist in one complete rotation of at least one hand after the latter has been brought back into its initial temporal reference position.

In the preferred embodiment in which the hands are both solicited, the signalling means consist in a simultaneous rotation of both hours and minutes hands at the same speed, in a constant relative angular position, for example in superposition.

Such signalling means are advantageously applied for the indication of entry into an operational mode such as changing of the temporal reference since the specific movement of the time displaying hands through a complete rotation and in the same sense indicate in a very clear manner an important change in the display of time.

Adjustment Phase

Conforming to the application described and continuing with reference to document CH 03031/90-0 (U.S. Ser. No. 07/761 232) mentioned hereinabove, the user defines in such phase the new temporal reference position in marking by means of the hours h and minutes m hands, the chosen position for such new temporal reference. The displacement of the hands is controlled by the control stem, the movement of the latter being interpreted by the circuit 24 which sends corresponding pulses to input D of the management or adjustment means 22 which, in turn, emit on outputs Mmn and Mh control pulses towards motors 18 and 20.

Preferably, in this phase, the hands remain constantly superposed. In other words, the management means 22 or the user send the same pulses towards both motors 18 and 20. This enables the user to better take into account that the timepiece is in the adjustment mode.

As is well understood and as mentioned hereinbefore, it is also possible to form the management or adjustment means 22 in a manner such that one only of the hands is used in order to indicate the temporal reference position.

There can also be chosen a different temporal reference position for the minutes hand and for the hours hand. For example, with six o'clock (or eighteen hundred) as temporal reference position, the hands are exactly opposite one another.

Display Phase

When the user has marked the desired new position for the temporal reference, he leaves the adjustment mode by a special manipulation of the control stem. The management means 22 then read the contents of the minutes 8 and hours counters 12 which define the present time and emit the corresponding number of pulses towards motors 18 and 20 in order to displace the hands from the reference position towards the display position of current time.

The adjustment example which follows illustrates the operation of the timepiece according to the invention.

On FIG. 2, there has been shown at step A a timepiece here forming a wristwatch intended to be worn on the left wrist. The control stem is thus at the right. The dial is provided with four different indices at 12 o'clock, 3 o'clock, 6 o'clock and 9 o'clock. The minutes and hours hands each make sixty steps per rotation of the dial.

In a known manner, noon and midnight are marked by the superposition of the hands at 12 o'clock. This position is chosen as temporal reference. Current time is thus 10 hours 11 minutes. The contents CPmn of the minutes counter is thus equal to 11, and the contents $CP_H$ of the hours counter is 50.

When the user passes into the adjustment mode as shown at step B, both hands are displaced until found in the temporal reference position (initialization phase). They are then superposed at 12 o'clock.

Next, and in conformity with the invention, as shown at step C, the alert phase comes into operation in an automatic manner by the signalling means. The values Rmn and Rh from registers 27 and 29 are taken into account by the electronic management means 22 which furnish a corresponding number of pulses (here 60) to motors 18 and 20.

The two hands h and m then effect a complete rotation preferably at high speed, in a superposed configuration in order to warn the user of entry into this operational mode which here is a non-time operational mode. At the end of this rotation, they are found again in their temporal reference position, which has not yet changed (step D).

The user next defines (step E) the new position desired for the temporal reference, in marking such position with the hands (adjustment phase) with the help of a manual operation on the crown.

As is seen, the new position of the temporal reference is chosen by the user to be at 6 o'clock.

This signifies that, at noon or at midnight, the hands will henceforth, in the normal time display mode, be in the position shown in this step.

The user then leaves the adjustment mode. At this moment, the management means 22 displaces the hands (display phase) in order that they display the present time in taking into account the new position of the temporal reference by advancing each hand through a number of steps equal to the contents of the corresponding counter (step F).

In another embodiment, an alert phase is put into operation before return to the current time display in order to warn the user that he has left the adjustment mode.

It must be noted that during the entire adjustment operation, the counters continue to be normally incremented by the time base so that the number of steps by which it is necessary to advance the hands is not necessarily equal to the contents of the counters at the beginning of the adjustment operation.

The wristwatch can now be worn on the right wrist with the control stem at the left. The adjustment of the temporal reference position permits having both hands superposed when it is noon or midnight.

In the embodiment described hereinabove, the temporal reference is indicated in the adjustment phase by the position of the superposed hands which is also their position during a rapid displacement through 360°, in the alert phase. It is clear that in order to be able to superpose the hands and displace them together, the timepiece movement must include two independent motors, one for each hand.

In the case of a single motor for driving both hands, the position of a predetermined hand can be used in order to indicate the temporal reference position. In order to adjust such temporal reference, it is necessary, as is well understood, to have available a declutching system in order to interrupt the kinematic coupling between the two hands, at least during the display phase. This can be easily obtained by coupling a wheel in the kinematic chain to the control stem.

In an advantageous manner, the adjustment means may be provided with a table containing a limited number of authorized positions for the temporal reference. Such table is preferably filled in the factory by the timepiece designer.

Specifically, it can be obligatory that the possible positions are the four positions which in a normal watch indicate 3 o'clock, 6 o'clock, 9 o'clock and 12 o'clock.

What I claim is:

1. A timepiece having an analog display exhibiting at least two selectable operating modes, a first retorted to as time mode and a second referred to as non-time mode, and comprising at least one hours hand and one minutes hand capable of being independently actuated by motor means, electronic management means for said modes of operation and a control organ capable of operating said management means, and including visual means for signalling entry into the non-time mode of operation and acting at least upon entry into this mode of operation, wherein said visual signalling means are formed by said hours and minutes hands and by their concomitant displacement said displacement being made for a complete rotation of both hands in a same angular direction.

2. A timepiece as set forth in claim 1, wherein said complete rotation of both hours and minutes hands is achieved after the latter have been brought into an initial temporal reference position.

3. A timepiece as set forth in claim 1, wherein said visual signalling means consist of a rotation of both the hours and minutes hands at the same angular speed, said hours and minutes hands maintaining a relative predetermined position during said rotation.

4. A timepiece as set forth in claim 3, wherein said visual signalling means consist of a rotation of the hours and minutes hands in a superposed configuration after they have been brought into such configuration at an initial temporal reference position.

5. A timepiece as set forth in claim 1, including two registers referred to as signalling registers, coupled to said management means and respectively containing two values Rmn and Rh repetitively representative of two numbers necessary for the complete rotation oil both the hours and minutes hands, both such values Rmn arid Rh being equal to 60.

* * * * *

UNITED STATES PATENT AND TRADEMARK OFFICE

CERTIFICATE OF CORRECTION

PATENT NO. : 5,379,281
DATED : January 3, 1995
INVENTOR(S) : Daniel KOCH

It is certified that error(s) appears in the above-identified patent and that said Letters Patent is hereby corrected as shown below:

Column 7, line 32, delete "retorted", and insert --referred--.

Column 8, line 31, delete "oil", and insert --of--.

Signed and Sealed this

Third Day of March, 1998

*Attest:*

*Attesting Officer*

BRUCE LEHMAN

*Commissioner of Patents and Trademarks*